United States Patent [19]

Teplinsky et al.

[11] 4,190,096

[45] Feb. 26, 1980

[54] MANIPULATOR FOR SEPARATING COATED PERMANENT MOULDS

[76] Inventors: Anatoly D. Teplinsky, ulitsa Generala Petrova, 27, korpus 1, kv. 73; Yakov M. Ryvkis, ulitsa Garibaldi, 14, kv. 26; Rostislav L. Snezhnoi, ulitsa B. Khmelnitskogo, 36, kv. 12; Leonid Y. Netes, ulitsa Akademika Filatova, 82/2, kv. 101, all of Odessa, U.S.S.R.

[21] Appl. No.: 897,539

[22] Filed: Apr. 17, 1978

[51] Int. Cl.[2] ..... B22D 29/04; B22D 33/02

[52] U.S. Cl. ..... 164/158; 164/347; 164/409

[58] Field of Search ..... 164/158, 213, 224, 344, 164/347, 409, 404, 131

[56] References Cited

U.S. PATENT DOCUMENTS

| | | | |
|---|---|---|---|
| 1,531,356 | 3/1925 | Stubbs | 164/347 X |
| 2,582,891 | 1/1952 | Strauss | 164/347 X |
| 2,724,878 | 11/1955 | Valyi | 164/158 |
| 3,150,425 | 9/1964 | Carpenter et al. | 164/323 X |
| 3,199,157 | 8/1965 | Fellows | 164/404 |
| 3,627,022 | 12/1971 | Schields | 164/224 |

FOREIGN PATENT DOCUMENTS

| | | | |
|---|---|---|---|
| 459305 | 3/1975 | U.S.S.R. | 164/347 |

*Primary Examiner*—Robert D. Baldwin
*Assistant Examiner*—Gus T. Hampilos
*Attorney, Agent, or Firm*—Haseltine, Lake & Waters

[57] ABSTRACT

A manipulator for use in effecting separation of split coated permanent moulds and for cleaning air injection holes in one of the mould parts. The manipulator comprises a frame with a hoist mechanism accommodated in its bottomm portion to lift the metal moulds in position for separation. Clamping device and a turnover device are mounted on the frame above the hoist mechanism. The frame also carries a broaching mechanism mounted above the clamping devices adapted to push out a casting from one part of the mould into another one while concurrently removing the used coating from the air injection holes.

8 Claims, 8 Drawing Figures

MANIPULATOR FOR SEPARATING COATED PERMANENT MOULDS

BACKGROUND OF THE INVENTION

1. Field of Application

The present invention relates to coated permanent-mould casting automatic lines used in foundry practice. More specifically, the invention is directed to manipulators intended for effecting separation of coated metal moulds.

It is known to produce high-quality castings in coated permanent moulds of, practically, any shape and from various metals, inclusive of cast-iron with flaked and globular graphite, carbon and alloy steels, etc. The castings may be made of various sizes ranging from dozens of millimeters to one and more meters and from hundreds of grams to 300 and more kilograms.

Coated permanent mould casting method is advantageously used for making crankshafts employed in the automobile and tractor engines, diesel engines, camshafts for automobile engines, frameworks for electric motors, axle-boxes for railway cars, hydraulic system control valve bodies, drive sprockets for tractors and many other suchlike parts.

The coated permanent-mould casting process invariably includes the steps of separating the mould after solidification of the metal poured thereinto, removing the solidified casting therefrom, and cleaning the air injection holes in the split parts of the mould.

There is known in the art various foundry system flask unloading apparatus'. In the foundry system of this type, the mould sand and cast material are separately removed from the cope and drag of a flask type foundry mould. The shake-out operation is effected by conventional methods, i.e. by subjecting the mould with the casting to jolting or else by squeezing out the content of the mould with the casting onto special broaching dies, whereupon the cope and drag of the mould are disengaged. In the event one of the mould parts, usually the drag, comprises a cross-bar, the shake-out operation is preceded by the operations of removing the mould cope and turning over the mould drag. Similar operating processes are described in U.S. Pat. No. 3,150,425 and in U.S. Pat. No. 3,199,157. In the apparatus of the patents referred to above, the mould cope is separated at one station while the operations of tilting and damping the cast material from the mould drag is effected at another station. The operation of tilting the mould cope is not effected since it is not specified by the operating process.

In the coated permanent-mould casting process, the mould top part and bottom part are to be separated before the casting is knocked out therefrom and the mould coating is removed from the air injection holes of the mould parts. The mould separating operation is preferably carried out concurrently with the broaching of holes in the mould top part, whereby the casting is held in the mould bottom part. In addition, the coated permanent-mould casting process requires the coated mould top part to be tilted so as to undergo the following technological operations, namely: the removal of used coating therefrom, the cooling and quality control of the cleaning operation effected in the flow-line production. Consequently, the flask handling equipment described in the patents referred to above is unfit for separating permanent moulds.

SUMMARY OF THE INVENTION

It is a principal object of the invention to provide a manipulator for separating split permanent moulds.

Another object of the invention is to provide a manipulator for separating split permanent moulds, also operable to push out the casting from one of the mould parts into another one.

Still another object of the invention is to provide a manipulator which is capable of performing, in addition to the aforementioned operations, the operation of cleaning air injection holes in the free part of the mould.

Yet still another object of the invention is to provide a manipulator which is capable of performing in addition to the aforementioned operations the operation of tilting the mould part released from the casting.

These and other objects and features of the present invention are attained in a manipulator for use in effecting separation of coated permanent moulds comprised of two parts formed with air injection holes, comprising in accordance with the invention a frame carrying a hoisting mechanism to deliver and place a coated permanent mould in position for its separation; clamping devices to grip separate parts of the mould being separated and stationary mounted on the frame above the hoisting mechanism in direct proximity to the place of separation; a turnover device adapted to tilt the clamped part of the coated mould, and a broaching mechanism mounted on the bed frame above the hoisting mechanism and intended to push out a casting from one of the coated mould parts into another one while concurrently cleaning air injection holes of the used coating.

Such manipulator construction permits automatic operation of separating coated permanent moulds, pushing out the finished casting from one of the mould parts into another one, the operation to be effected simultaneously with that of removing the used coating from air injection holes.

A broaching mechanism preferably comprises a cross-bar having a plate freely suspended therefrom and formed with a set of broaching pins arranged thereon to fit the air injection holes disposed in one of the mould parts, the cross-bar being kinematically linked with a drive fixed on the bed frame to transmit reciprocated motion thereto in the vertical.

This permits two automatic operations such as pushing-out of the casting and cleaning the air holes of the used coating to be effected simultaneously.

The broaching mechanism is advantageously provided with centering pins arranged on the plate to fit centering holes formed in one of the mould parts and exceeding in length all the broaching pins.

This allows for prompt and easy disposition of the broaching pins in readiness to fit into respective air injection holes.

The broaching pins may be possibly arranged into groups each including the pins of equal length uniformly distributed over the plate.

This permits separate groups of pins to be put into operation one after another, whereby the overall broaching force is substantially reduced.

The broaching mechanism can include two attachment units intended for fixing one of the mould parts in horizontal position and secured on the bed frame on the both sides of the mould tilting axis.

Each of said attachment units is preferably formed as a lever with a pivot rigidly fixed on the bed frame, kinematically linked with the plate by means of a connecting rod having its one end articulated thereon and formed with a longitudinally extending through slot adapted to receive a pin freely accommodated therein and mounted on the lever.

The provision of the attachment unit for fixing one of the mould parts in horizontal position prevents the mould part being tilted from turning around, whereby the power elements of the turnover device are relieved from undue stress and the pins are saved from breaking due to misalignment of the mould part.

The attachment unit for fixing one of the mould parts in horizontal position may comprise stops intended to arrest the movement of the lever, of which one stop is mounted on the plate and the other one on the bed frame. In addition, one end of the lever, bearing up against one of the mould parts, is preferably fitted with an adjustable stop or thrust member.

This permits the lever, thrusting up against the mould part being tilted, to be fixed in vertical position.

BRIEF DESCRIPTION OF THE DRAWINGS

The invention will be further described, by way of example only, with reference to the accompanying drawings, wherein.

DESCRIPTION OF THE PREFERRED EMBODIMENT

Figure 1:
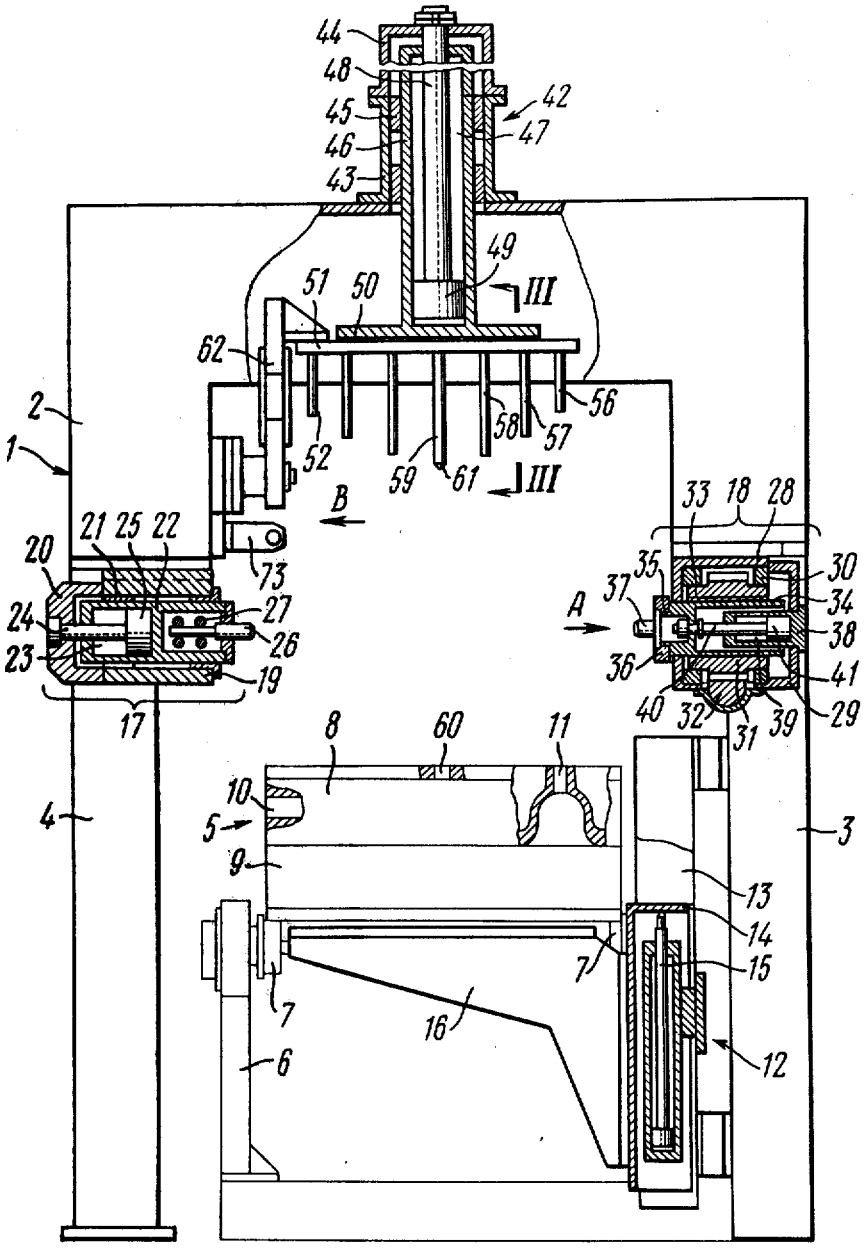
FIG. 1 is a schematic general view of a manipulator for use in effecting separation of coated permanent moulds according to the invention.

Referring now to the accompanying drawings and to FIG. 1 in particular, there is shown a manipulator for use in effecting separation of coated permanent moulds. The manipulator of the invention comprises a frame 1 which consists of a portal 2 and columns 3 and 4 rigidly connected with the portal 2.

A coated permanent mould 5 formed of two parts with a casting contained therein is delivered to be placed in position for its separation effected with the aid of a conveyer 6 which makes no part of the manipulator. Shown in FIG. 1 is an embodiment of the conveyer 6 made in the form of a live roller with the coated permanent mould 5 being conveyed on rollers 7 thereof. The mould 5 is placed in position for separation with the parting plane of the mould parts, a top part 8 and a bottom part 9, being disposed in the horizontal, no matter what this parting plane disposition might be during other process operations. The mould part 8 and part 9 are formed with alignment holes 10 and air injection holes 11. The air injection holes 11 are filled with the used coating to be removed.

In the bottom part of the frame 1 is a hoisting mechanism 12 intended to deliver the coated permanent moulds 5 which are thereby placed in working position. In the preferred embodiment of the invention, the hoisting mechanism 12 comprises a guiding plate 13 rigidly associated with the column 3. The guiding plate 13 carries a carriage 14 mounted to move in the vertical. The carriage 14 travels along the guides of the plate 13, which are not shown for the sake of simplicity. The carriage 14 is free to travel along the guides of the plate 13 either on rollers, slides or other conventional means. Secured on the plate 13 is a power cylinder 15 kinematically linked with the carriage 14 to thereby impart thereto linear upward and downward motion. Rigidly fixed on the carriage 14 are supports 16 which carry the mould 5 while the carriage 14 is caused to move. In the lower (initial) position of the carriage 14 the upper edges of the supports 16 are disposed below the rollers 7 to allow unhindered travelling for the mould 5 along the roller conveyer 6.

Fixedly attached on the portal 2 of the frame 1 are clamping devices 17 and 18 adapted to grip and hold the mould part 8 in the position pending separation of the mould 5. The clamping devices 17 and 18 are arranged on both sides of the mould 5 placed in position for separation. In the preferred embodiment of the invention, the clamping device 17 comprises a housing 19 with a cover 20, secured to the portal 2. Mounted within the housing 19 are sleeves 21 wherein is advancing a case 22 of a cylinder 23 having its rod 24 in assembly with a piston 25 rigidly fixed in the cover 20. Fitted on the end of the cylinder case 22 opposite the rod 24 is a rod 26. As the cylinder case 22 advances, the rod 26 enters the alignment hole 10 of the mould top part 8, thereby holding the latter in readiness for separation operation. The rod 26 is mounted in bearings 27, which facilitates the operation of tilting the mould top part 8 rendered thereby turnable together with the rod 26.

In the preferred embodiment of the invention, the clamping device 18 is associated with a turnover device intended to invert the top part 8 of the mould 5. The clamping device 18 comprises a housing 28 with a cover 29, secured to the portal 2 of the frame 1. Mounted within the housing 28 are sleeves 30 in which is installed a gear wheel 31 rotatable about its axis and kinematically linked with a mobile gear rack 32 also accommodated in the housing 28. The rack 32 is geared to an actuator intended to enable translatory motion, for example, a power cylinder (not shown).

Figure 2:
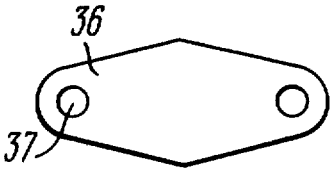
FIG. 2 is a schematic view taken in the direction shown by arrow A in FIG. 1 of a cross-bar, according to the invention.

Mounted in the gear wheel 31 on slots 33 is a tail spindle 34 which is allowed axial movement and has its end 35, facing the clamping device 17, rigidly fixed to a cross-bar 36 with two rods such as shown at 37 in FIG. 2 also fit to enter the pilot holes 10 of the mould top part 8 (FIG. 1).

Fixedly attached to the cover 29 is case 38 of a power cylinder 39 having its rod 40 in assembly with a piston 41 associated with the tail spindle 34.

The rods 37 are intended to hold the mould top half 8 in horizontal position and to translate torque from the gear wheel 31 to the mould top part 8.

The fact that the mould separating manipulator of the invention is provided with the turnover device for inverting the mould top part renders the manipulator fit for effecting the operations of separating and tilting, and permits the number of mechanisms as well as the length of the production line to be reduced.

Mounted in the top part of the manipulator on the portal 2 of the frame 1 is a broaching mechanism 42 adapted to push out the casting (not shown) into the bottom half-part 9 of the mould 5 and to clean the air injection holes 11 of the mould top half-part 8 of the used coating. The broaching mechanism 42 comprises a housing 43 secured to the portal 2 and fixedly connected with its cover 44. The housing 43 accommodates sleeves 45 in which is mounted a case 46 of a cylinder 47, movable along the housing 43 and having its rod 48 in assembly with a piston 49 rigidly fixed in the cover 44. Fixedly attached to the lower end portion of the cylinder case 46 is a cross-bar 50.

Freely suspended on the cross-bar 50 is a plate 51 formed with broaching pins 52 fixedly arranged thereon to fit into the air injection holes 11 in the top half-part 8 of the mould 5.

Figure 3:
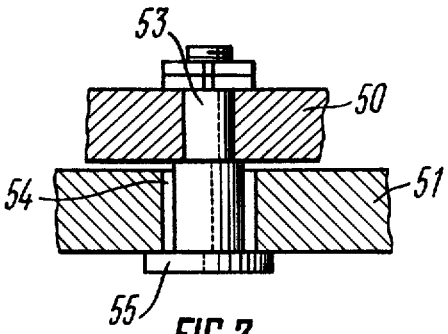
FIG. 3 is a cross-sectional view taken along plane III—III in FIG. 1 of an attachment unit shown in the direction of the cross-bar, according to the invention.

The plate 51 (see FIG. 3) is connected to the cross-bar 50 by means of pins 53 rigidly fixed in the cross-bar 50. The pins 53 loosely pass through holes 54 in the plate 51 and are formed with shoulders such as shown at 55, whereupon is suspended the plate 51 with an opening extending vertically relative to the cross-bar 50.

The broaching pins 52 (FIG. 1) may be made equal in length. However, it is preferable to have said pins formed into groups of different lengths, such as shown at 56, 57 and 58, each group comprising the pins 52 of similar length thus enabling subsequent group of the pins 52 to be put in operation after the preceeding group of larger-in-length pins 52 have completed the operation of cleaning the oppositely spaced holes 11 in the mould top half-part 8. In this way it becomes possible to substantially reduce the force of broaching and to thereby bring down the amount of metal and power input required for a manipulator. The pins 52 of each such group are preferably arranged symmetrically with respect to the axis of tilting of the mould top half-part 8.

Rigidly fixed on the plate 51 are centering pins 59 the length of which exceeds that of the longest broaching pins 52. It is with the aid of the pins 59 which enter centering holes 60 in the mould top half-part 8 as the plate moves downward before the broaching pins 52 have reached this part 8 that the centering of the plate 51 freely suspended from the cross-bar 50 is effected relative to the air injection holes 11 in the mould top half-part 8. The pins 59 are preferably formed with a tapered guiding end 61, which facilitates the operation of centering the plate 51.

In the preferred embodiment of the invention, two centering pins 59 are used to ensure satisfactory centering of the plate 51, though the centering pins may vary in number.

The fact that the plate 51 is made "floatable" permits accurate alignment of the broaching pins 52 in the plate 51 with the air injection holes 11 fitted in the half-part 8 of the mould 5, obviating the need to complicate the manipulator construction. The manipulator of the invention is provided with two attachment units 62 intended to fix the mould top half-part 8 in the horizontal position and secured on the frame 1 on both sides of the tilting axis to relieve the turnover device from stresses occurring in the process of the mould separation and asymmetrical in relation to the axis of tilting forces, and to fix the mould top half-part 8 in the horizontal position during separation.

Figure 5:
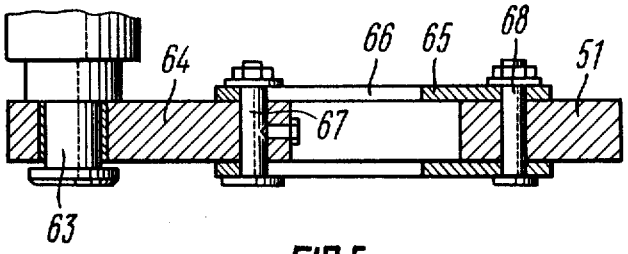
FIG. 5 is a cross-sectional view taken along plane V—V in FIG. 4 of levers and connecting rods, according to the invention.
Figure 4:
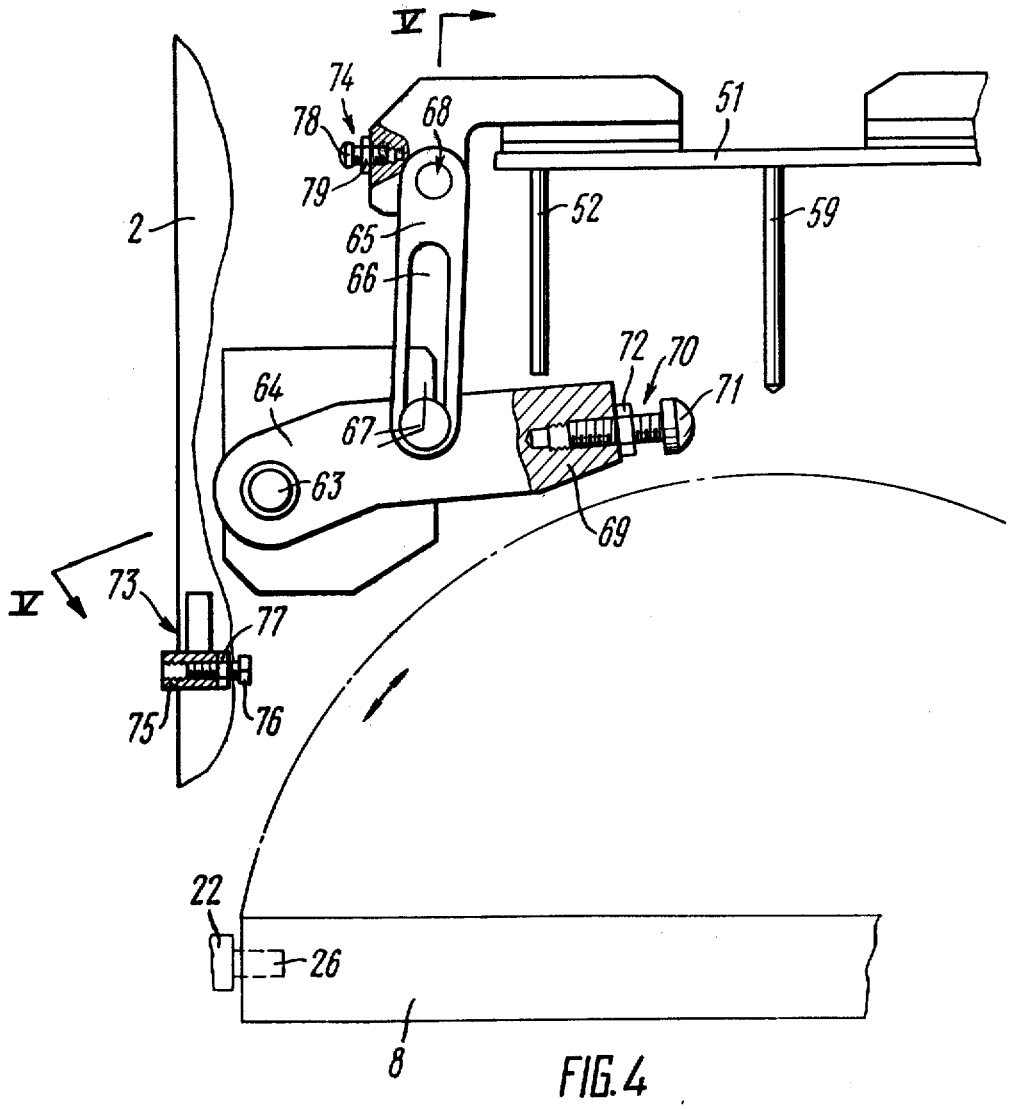
FIG. 4 is a schematic view taken in the direction of arrow B in FIG. 1 of an attachment unit for fixing one of the mould parts in horizontal position, according to the invention.

The attachment unit 62 (FIGS. 4 and 5) comprises an axle 63 rigidly fixed on the portal 2 of the frame 1, a lever 64 articulated on the axle 63, and a connecting rod 65 formed with a through longitudinal slot 66. Fitted in the middle part of the lever 64 is a pin 67 which freely enters the slot 66 in the connecting rod 65. The other end of the connecting rod 65 is pivotally connected to the plate 51 by means of the axle 68.

In the preferred embodiment of the invention, there are provided two connecting rods 65 intended to ensure reliable connection, though it is also possible to use one connecting rod 65 as well.

To provide for convenient setting, the lever 64 has its end 69, thrusting up against the mould top half part 8, fitted with an adjustable stop 70 which is preferably made in the form of a screw 71 and a locknut 72.

With the plate 51 being in its upper position, the lever 64 is raised to permit tilting of the top half-part 8 of the mould 5.

In order to fix the lever 64 in a vertical position, in which it is found prior to broaching of the air injection holes 11 and in which it remains until the completion of the separating operation, adjustable stops 73 and 74 for limiting the movement of the lever 64 are mounted on the portal 2 and of the plate 51. The stop 73 is rigidly fixed on the portal 2 and comprises, in the preferred embodiment of the invention, a housing 75, a screw 76 and a locknut 77. The stop 74 is mounted on the plate 51 and made, in the preferred embodiment of the invention, in the form of a screw 78 and a locknut 79.

Due to employing one manipulator only for use in effecting the operations of the mould separation and cleaning the air injection holes in the mould top half-part of the used coating, the operating cycle of, and the number of mechanisms utilized in the foundry system incorporating the manipulator of the invention are substantially reduced, the floor space required for such foundry systems is diminished and their operation is rendered more simple.

The manipulator according to the invention for separating coated permanent moulds operates in the following manner.

The coated permanent mould 5 (FIG. 1) in assembly is conveyed by the roller conveyer 6 to be thereby placed in position for separation. The mould 5 is preplaced so that the parting plane of its top half-part 8 and bottom half-part 9 extend horizontally. After the mould 5 is arranged in position for separation, the cylinder 15 of the hoisting mechanism 12 is operable to lift the carriage 14 from the support 16. The carriage 14 is driven along the guides of the plate 13. During upward movement of the carriage 14 the supports 16 bear up against the mould 5, found on the rollers 7 of the roller conveyor 6, and raise the mould 5 to thereby fix the latter in position for separation, in which the alignment holes 10 in the top half-part 8 of the mould 5 are positioned opposite the rods 26 and 37 of the clamping devices 17 and 18.

The case 22 (FIGS. 1 and 6) of the cylinder 23 of the clamping device 17 is moved together with the rod 26 towards the mould 5, whereupon the rod 26 enters the alignment hole 10 in the top half-part 8 of the mould 5.

Figure 6:
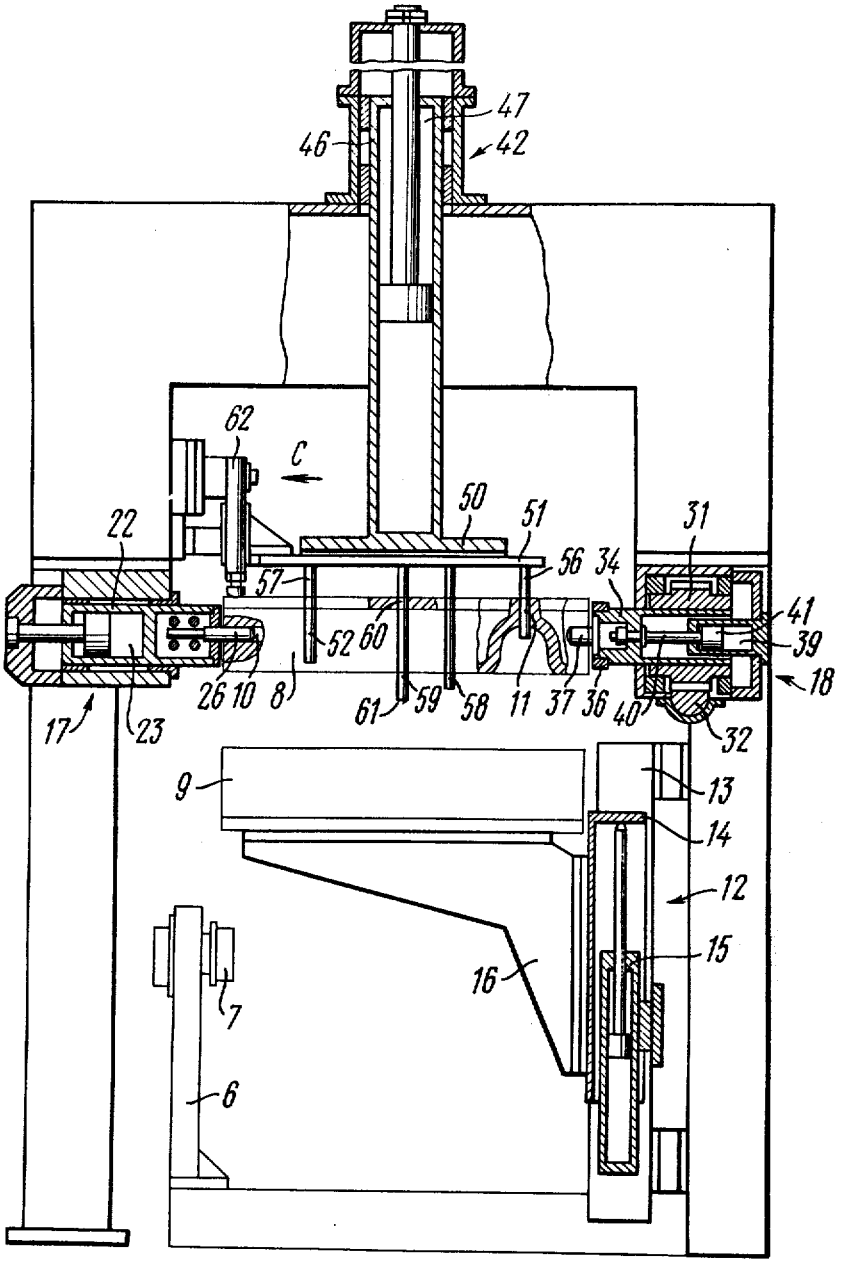
FIG. 6 is a schematic general view of a manipulator in position after separation of a coated permanent mould, according to the invention.

Simultaneously the piston 41 in assembly with the rod 40 of the cylinder 39 incorporated in the clamping device 18 commences its movement. The rod 40 is operable to displace the tail spindle 34 together with the cross-bar 36 and rods 37 towards the mould 5, whereupon the rods 37 enter respective alignment holes 10 in the top half-part 8 of the mould 5. After the rods 26 and 37 are received in the holes 10, the top half-part 8 of the mould 5 is fixed in the horizontal position such as shown in FIG. 6.

The mould separating operation is effected under the condition of appropriate disposition of a casting in a given part of the mould. With the parting plane of the mould parts extending horizontally, the casting should remain in the mould bottom part, since special process techniques will be needed to hold the casting in the mould top part. This, however, will substantially complicate the production process and the mould construction, as well as enable the production of castings of a limited size and type.

Since the operation of cleaning the air injection holes in the aforementioned parts of the mould succeeds the operation of the casting removal from the mould parts, the air injection holes cleaning operation is preferably combined with the mould separating operation. This permits the production efficiency to be enhanced and obviates the need to employ special mechanism for cleaning the air injection holes in the mould top part.

After the mould top part 8 is clamped, the case 46 of the cylinder 47 incorporated in the broaching mechanism 42 is displaced together with the cross-bar 50, plate 51, broaching pins 52 and centering pins 59 towards the mould 5, i.e. in the downward direction.

Figure 7:
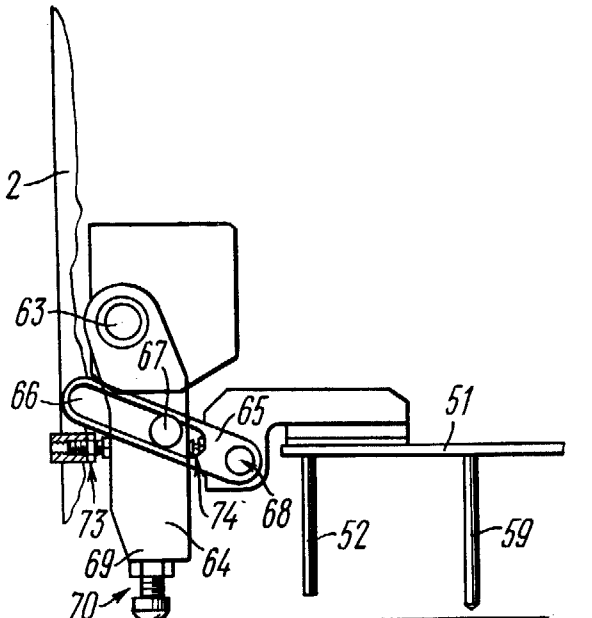
FIG. 7 is a schematic view taken in the direction shown by arrow B in FIG. 1 of the attachment unit for fixing the mould top part in horizontal position at the onset of broaching operation performed on the air injection holes of the mould top part, according to the invention.

The connecting rod 65 (FIGS. 4 and 7) is brought down together with the plate 51. As the connecting rod 65 goes downward, the lever 64 of the attachment unit 62 for fixing the mould top part 8 in the horizontal position is brought down by gravity and the pin 67 of the lever 64 slides over the longitudinal through slot 66 of the connecting rod 65 thereby causing the latter to turn about the axle 68. As the centering rod 59 approaches the half-part 8 of the mould 5 the lever 64 occupies vertical position (FIG. 7). The lever 64 is fixed in this position by means of the adjustable stop 73 mounted on the portal 2 and by the adjustable stop 74 mounted on the plate 51. The adjustable stop 70, fitted on the end 69 of the lever 64, bears up against the top half-part 8 of the mould 5, thereby fixing the latter in position and preventing its turning.

In the course of further downward movement of the plate 51 (FIGS. 1 and 6), the centering pins 59 enter, their tapered ends 61 first, the centering holes 60 in the top half-part 8 of the mould 5 thereby bringing the plate 51 in alignment with the broaching pins 52 relative to the mould half-part 8, whereupon the broaching pins 52 are operable to clean the air injection holes 11 in the mould half-part 8. As this happens, the cylinder 15 is reset for the downward stroke. The groups 56, 57, 58 of the broaching pins 52 are successively operable to clean the air injection holes 11 in the mould top half-part 8, concurrently squeezing out the casting (not shown) into the mould half-part 9 to be lowered together with the supports 16 and carriage 14 by means of the cylinder 15 onto the rollers 7 of the roller conveyer 6.

Mutual arrangement of the mechanisms and half-parts 8 and 9 of the mould 5 is schematically shown in FIG. 6.

Figure 8:
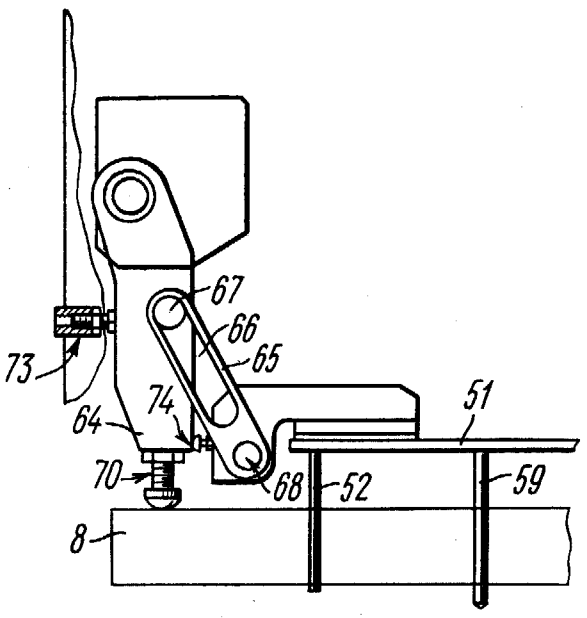
FIG. 8 is a general view taken in the direction shown by arrow C in FIG. 6 of the attachment unit for fixing the mould top part in horizontal position upon completion of the separating operation, according to the invention.

The lever 64 (FIGS. 7 and 8) remains fixed in vertical position till the end of the separating operation, and the connecting rod 65 continues, during the downward movement of the plate 51, to slide with its slot 66 over the pin 69 of the lever 64 and turns about the axle 69 to occupy, towards the end of the separating operation, position such as shown in FIG. 8.

Upon completion of the separating operation, the mould bottom half-part 9 with the casting is conveyed by the roller conveyer 6 out of the operating range of the manipulator to undergo further operations. The plate 51 is lifted with the aid of the case 46 of the cylinder 47, whereupon all the parts of the broaching mechanism 42 and of the attachment unit 62 are returned to original position such as shown in FIG. 1.

Since the operation of tilting the top half-part 8 of the mould 5, joint face up, is specified by the technological process, the manipulator of the invention is suitably adapted to perform this operation as well.

After the mould bottom half-part 9 is separated and brought away by the roller conveyer 6 (FIG. 6), the tail spindle 34 with the cross-bar 36 and rods 37 is caused to turn through 180 deg. by means of the gear wheel 31, rack 32 and the rack drive (not shown). In the course of turning movement of the cross-bar 36 the rods 37 cause the top half-part 8 of the mould 5 to turn about the axis of the rods 26.

Upon completion of the tilting operation, the carriage 14 together with the supports 16 is lifted by means of the cylinder 15 to upper position in which the supports 16 bear up against the top half-part 8 of the mould 5. The rods 26 and 37 of the clamping devices 17 and 18 are withdrawn from the alignment holes 10 in the mould half-part 8 to occupy position such as shown in FIG. 1. The rods 26 and 37 are brought out in reverse order. By means of the carriage 14 the mould half-parts 8 are lowered onto the rollers 7 of the roller conveyor 6 which is operable to transfer the mould half-part 8, its joint up, beyond the operating range of the manipulator.

From the above it follows that the manipulator according to the invention makes it possible to combine such operations as separation of a mould, squeezing out the casting from one of the mould parts into another one, cleaning of the air injection holes and subsequent tilting of the other part of the mould. With the manipulator of the invention, if incorporated in the foundry system, it becomes feasible to enhance the production efficiency of and reduce floor space required for such foundry systems, rendering them less costly and complicated in construction as well as easy in operation.

What is claimed is:

1. A manipulator for use in effecting separation of split coated permanent metal moulds having two parts formed with air injection holes and a parting plane disposed horizontally when in a position for separation, comprising, a frame;

a hoisting mechanism operable to deliver and place said coated permanent moulds in position for separation mounted on said frames and having:

a guiding plate rigidly fixed on said frame, a carriage mounted on said guiding plate, supports adapted to carry said permanent mould being rigidly fixed on said carriage, a power cylinder rigidly connected with said guiding plate and geared to said carriage for transmitting up and down linear movement to the latter;

two clamping devices mounted on said frame adapted to grip the top part of said mould when in position for separation;

one of said clamping devices being a housing rigidly fixed on said frame, a power cylinder incorporating a case mounted in said housing for axial movement therealong, a rod fixed in said housing, a piston rigidly fixed to said rod, a bar mounted on the end of said case to move therewith in the course of clamping and releasing of said mould part;

the other clamping device being a housing rigidly fixed on said frame, a power cylinder incorporating a case rigidly fixed in said housing, a rod movably mounted with respect to said case, a piston rigidly fixed to said rod, a tail spindle kinematically linked with said rod and effecting translatory motion therewith, a cross-bar fixedly attached to said tail spindle, at least two bars rigidly fixed on said cross-bar and effecting translatory motion therewith in the course of clamping and releasing said mould part;

a turnover device mounted on said second-mentioned clamping device for handling the mould top part being defined by, an actuator, a gear rack mounted in the housing of said second-mentioned clamping device and geared to said actuator operable to transmit translatory motion thereto relative to said housing, a gear wheel mounted in said housing being brought into engagement with said rack and operable to transmit rotational motion to said gear wheel, said wheel being kinematically linked through a slot connection with said tail spindle and rotating therewith;

a broaching mechanism fixed on said frame above said clamping devices, being operable to push out during separation of the finished casting from said top part of the mould into the bottom part thereof, and concurrently cleaning the air injection holes in said top part of the mould of the used coating.

2. A manipulator as claimed in claim 1, wherein said broaching mechanism comprises:

a housing rigidly fixed on said frame;

a power cylinder incorporating a case mounted in said housing for reciprocal movement therealong in the vertical direction, a rod fixed in said housing, a piston rigidly fixed to said rod, a cross-bar rigidly fixed on said case movable to transmit said reciprocal motion thereto, a plate freely suspended on said cross-bar and movable therewith;

broaching pins rigidly fixed on said plate and corresponding in number and disposition to the number and disposition of said air injection holes in the top part of said mould into which the broaching pins enter in the course of translatory motion of said plate, thus pushing out said casting and concurrently cleaning these holes.

3. A manipulator for use in effecting separation of split coated permanent moulds comprised of two parts formed with air injection holes and centering holes, having parting plane thereof disposed horizontally when in position for separation, as claimed in claim 2, wherein: said broaching mechanism comprises centering pins fixed on said plate to fit said centering holes in one of the mould parts and exceeding in length all said broaching pins.

4. A manipulator as claimed in claim 2, wherein said broaching pins are formed into groups, with the pins of one of such groups being similar in length and uniformly distributed over said plate.

5. A manipulator as claimed in claim 2, wherein said broaching mechanism comprises two attachment units adapted to fix the top part of said mould in horizontal position relative to horizontally disposed parting plane of the mould part and being rigidly fixed on said frame on the both sides of the tilting axis of said mould part.

6. A manipulator as claimed in claim 2, wherein said broaching mechanism additionally comprises:

two attachment units adapted to fix the top part of said mould in horizontal position and rigidly fixed on said frame on the both sides of the tilting axis of said mould part, each of said attachment units being an axle fixedly mounted on said frame, a lever mounted on said axle to turn thereabout, a pin fixedly attached to said lever, a guide rod pivotally connected to said plate being formed with a longitudinally extending through slot adapted to receive said pin.

7. A manipulator as claimed in claim 6, wherein the attachment unit for fixing the mould top part in horizontal position comprises at least two adjustable stops intended for limiting the movement of said lever, one of said stops being mounted on said plate to bear up against one side of said lever, the other stop being mounted on said frame to bear up against the other side of said lever thereby fixing the latter in vertical position.

8. A manipulator as claimed in claim 6, wherein the attachment unit for fixing the mould top part in horizontal position comprises an adjustable stop fitted on the end of said lever thrusting up against said top part of the mould when being fixed in position.

* * * * *